US006029572A

United States Patent [19]

Rodi

[11] Patent Number: 6,029,572

[45] **Date of Patent: *Feb. 29, 2000**

[54] SHEET CONVEYING SYSTEM IN A DIGITAL PRINTING PRESS

[76] Inventor: Anton Rodi, Karlsruher Strasse 12, D-69181 Leimen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/673,030

[22] Filed: Jul. 1, 1996

[30] Foreign Application Priority Data

Jun. 30, 1995 [DE] Germany ..... 195 23 879

[51] Int. Cl.[7] ..... B65H 7/02; B65H 7/14

[52] U.S. Cl. ..... 101/215; 101/484; 271/265.01

[58] Field of Search ..... 101/484, 217, 101/215; 271/265.01; 118/676, 679, 712; 427/8, 428

[56] References Cited

U.S. PATENT DOCUMENTS

| | | | |
|---|---|---|---|
| 3,461,798 | 8/1969 | Bulk et al. | 101/184 |
| 3,608,515 | 9/1971 | Tobias | 118/676 |
| 3,707,943 | 1/1973 | Matsumoto et al. | 118/676 |
| 4,037,952 | 7/1977 | Matsumoto | 399/242 |
| 5,476,545 | 12/1995 | Schrauwers et al. | 118/679 |
| 5,495,326 | 2/1996 | Mikida | 271/110 |

FOREIGN PATENT DOCUMENTS

| | | |
|---|---|---|
| 0 416 919 | 5/1994 | European Pat. Off. . |
| 15 36 449 | 6/1979 | Germany . |
| 690 08 647 | 8/1994 | Germany . |

*Primary Examiner*—John Hilten
*Assistant Examiner*—Daniel J. Colilla
*Attorney, Agent, or Firm*—Herbert L. Lerner; Laurence A. Greenberg

[57] ABSTRACT

Method of controlling a printing device of a printing press wherein substrates to be printed are conveyed on a conveying path to the printing device, the conveyed substrates being detected by a sensor disposed along the conveying path, upstream of the printing device, as viewed in a conveying direction of the substrate, includes starting a printing operation whenever a leading edge of a respective substrate is detected, and stopping a printing operation whenever a trailing edge of the substrate is detected.

3 Claims, 2 Drawing Sheets

SHEET CONVEYING SYSTEM IN A DIGITAL PRINTING PRESS

BACKGROUND OF THE INVENTION

FIELD OF THE INVENTION

The invention relates to a method of controlling a printing device of a printing press wherein substrates or printing stock to be printed, such as sheets of paper, for example, are conveyed on a conveying path to the printing device, and the conveyed printing stock are detected by a sensor disposed along the conveying path, upstream of the printing device, as viewed in the conveying direction of the printing stock.

The published German Patent Document DE 690 08 647 T2 (corresponding to the European Patent Document EP 0 416 919 B1) shows an electro-photographic printer wherein a sensor disposed along the conveying path monitors the interval of time between the beginning of a conveying process and the instant of the detection of the leading edge of a substrate or stock. If this time interval is identical with a construction-dependent prescribed interval of time, the printing process is enabled; if this time interval is smaller than the prescribed time interval, the printing process is blocked and the substrate or stock runs through the printing press without having been printed. Thereby, when substrates or stock are prematurely fed or pulled in, a printing process which is out of rhythm or synchronism with the appertaining substrate or stock is prevented from being performed.

It is accordingly an object of the invention to provide a method of controlling a printing device which avoids even more reliably the performance of printing processes which are out of rhythm or synchronism with the respective substrates, and to achieve this capability without having to take blank sheets into consideration.

With the foregoing and other objects in view, there is provided in accordance with the invention, a method of controlling a printing device of a printing press wherein substrates to be printed are conveyed on a conveying path to the printing device, the conveyed substrates being detected by a sensor disposed along the conveying path, upstream of the printing device, as viewed in a conveying direction of the substrate, which comprises starting a printing operation whenever a leading edge of a respective substrate is detected, and stopping a printing operation whenever a trailing edge of the substrate is detected.

In accordance with another mode of the method according to the invention, wherein the printing operation requires a time interval from the start thereof to an instant of time at which a printing image is transferred onto a respective substrate, the method includes transferring the printing image in synchronism with the respective substrate conveyed to the printing device by disposing the sensor at such a distance with respect to the printing device that such a synchronism occurs.

In accordance with a further mode of the method according to the invention, wherein the printing operation includes applying a printing image at a location of the circumference of a image-transfer cylinder onto the image-transfer cylinder, and transferring the printing image at another location of the circumference of the image-transfer cylinder onto a respective substrate, the method includes placing the sensor at a distance from the location at which the printing image is transferred onto the respective substrate, which distance is equal to a distance from the location at which the printing image is applied to the image-transfer cylinder to the other location of the circumference of the image-transfer cylinder at which the printing image is transferred to the respective substrate.

In accordance with a concomitant mode, the method according to the invention includes activating a feeder of the printing press for depositing a succeeding substrate on the conveying path whenever the trailing edge of a preceding substrate is detected.

SUMMARY OF THE INVENTION

According to the invention, the precise state of motion of the substrate prior to its reaching the sensor does not matter at all. Thus, the substrates may be successively transferred, for example, by a feeder to a conveying device which conveys the substrates to the printing device, without having to maintain a precise instant of time for the transfer or precise spacings or intervals between the substrates. Because each substrate passing the sensor is printed, no blank substrates are produced. If any waste is produced at all, it occurs only if a substrate which is too short is supplied to the conveying device. In this case, however, printing beyond the length of the substrate is reliably avoided by the fact that the printing process is stopped by the trailing edge of the substrate.

The invention is especially suitable for printing presses having digital printing units with a image-transfer cylinder rotating at a circumferential speed which is always identical to the conveying speed of the substrate-conveying device. With such a printing unit, the print image is applied at a location of the circumference of the image-transfer cylinder onto the image-transfer cylinder, and at another location thereof it is transferred from the image-transfer cylinder onto a respective substrate. The printing process thus requires a given interval of time from the start thereof to the transfer of the printing image onto a substrate.

In this case, the sensor is preferably disposed at a distance from the location at which the printing image is transferred onto the substrate which is equal to the distance between the location at which the printing image is applied to the imagetransfer cylinder and the location on the circumference of the image-transfer cylinder at which the printing image is transferred to the substrate. In regard to the foregoing, it is noted that in the case of a non-linear substrate-conveying path, "distance" means the overall length of the substrate motion between the sensor and the transfer location, whereas with respect to the image-transfer cylinder, "distance" means the path along the circumference thereof.

The printing process is started the instant the substrate is detected by a sensor disposed as mentioned above, and the transfer onto the substrate is automatically effected precisely at the correct location, without having to take into account and to maintain, respectively, any time intervals or conveying speeds. Compared with the method heretofore known from the aforementioned published German Patent Document DE 690 08 647 T2 requiring a given conveying speed, which has to be maintained at an absolutely constant level, and predetermined conveying paths preceding and following the sensor, the method according to the invention is much more flexible.

With the above-mentioned digital printing units, it is of great importance that the ink applied to the image-transfer cylinder be then completely transferred onto a substrate because, for reasons of operability, the impression cylinder must be prevented by all means from being soiled by nontransferred ink. Only a single substrate which would be fed non-synchronously or which would be too short somewhat would have detrimental effects. This is avoided by the invention reliably and very economically, because a feeder of the printing press does not have to work with the same accuracy as is required for supplying printing units with substrates.

In an embodiment of the invention, a feeder of the printing press is activated in order to transfer a succeeding substrate to the conveying device whenever the trailing edge of a substrate is detected. Alternatively, the feeder may be forcibly controlled together with the conveying device and the printing units, respectively, or it may be driven independently of the printing units so that the conveying capacity or throughput is predetermined by the working speed of the feeder. In all of these cases, very short distances between successively following sheets are realizable. When digital printing units are used, it is possible to attain an optimum performance output.

Other features which are considered as characteristic for the invention are set forth in the appended claims.

Although the invention is illustrated and described herein as a method of controlling a printing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Further features and advantages of the invention result from the following description of a specimen embodiment and the drawings.

DESCRIPTION OF THE PREFERRED EMBODIMENTS

Figure 1:
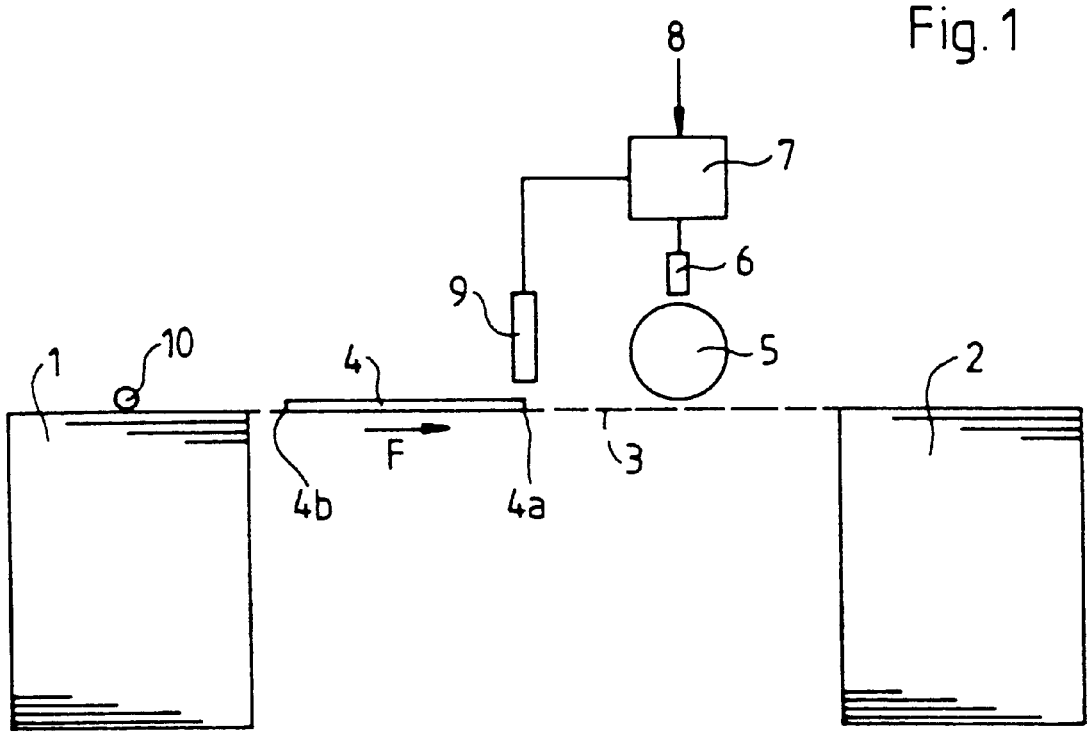
FIG. 1 is a diagrammatic and schematic side elevational view of a printing press for performing the method according to the invention.

Referring now to the drawings and, first, particularly to FIG. 1 thereof, there is shown therein a side elevational view of a printing press with reference to which the method according to the invention is explained hereinafter.

A sheet-conveying path 3 represented by a broken line extends between upper edges of a feeder pile 1 and a delivery pile 2. A non-illustrated sheet-conveying device which may be, for example, a conventional conveyor with chains and grippers or a conveyor belt, conveys sheets 4 from the feeder pile 1 rectilinearly along the conveying path 3 onto the delivery pile 2. A image-transfer cylinder 5 forming part of a digital printing unit is provided above and closely adjacent to the sheetconveying path 3. A recording or imaging head 6 of the digital printing unit is disposed at the circumference of the image-transfer cylinder 5, opposite the location at which it is disposed closely adjacent to the sheet-conveying path 3. The recording or imaging head 6 is controlled by signals produced by a control device 7 based upon digitized print images 8 (for example, text or graphics).

A sheet-detecting sensor 9, such as a light barrier, for example, is disposed between the feeder pile 1 and the imagetransfer cylinder 5. The sensor 9 is located a horizontal distance from the transfer location, i.e., the location at which the image-transfer cylinder 5 is disposed closely adjacent to the sheet-conveying path 3, the horizontal distance corresponding to the distance between the recording or imaging head 6 and the transfer location, i.e., equal to half the circumference of the image-transfer cylinder 5. An output of the sensor 9 is connected to the control device 7.

In operation, a sheet pull roller 10 draws a respective sheet 4 from the feeder pile 1 and deposits it on the conveying path 3. When the sensor 9 detects an edge 4*a* of the sheet 4 leading in a conveying direction represented by the arrow F, the control device 7 receives a respective signal transmitted by the sensor 9 and starts imaging or recording on the imagetransfer cylinder 5 by means of the recording or imaging head 6. When the leading edge 4*a* of the sheet 4 reaches the image-transfer cylinder 5, the print image transmitted thereon is transferred onto the sheet 4. When an edge 4*b* of the sheet 4 trailing in the conveying direction F passes the sensor 9, the output signal of the sensor 9 changes, and the control device 7 stops the imaging or recording. Thereafter, the remaining print image is transferred onto the sheet 4, and the sheet 4 is deposited on the delivery pile 2.

In the interest of clarity, FIG. 1 shows only a single sheet 4 on the conveying path 3. Preferably, the sheets 4 follow one another very closely, however, for example, at spaced intervals corresponding to the distance between the trailing edge 4*b* of the sheet, as shown in FIG. 1, and the leading edge of the feeder pile 1 and, every time the sensor 9 detects the trailing edge 4*b* of a respective sheet 4, the sheet pull roller 10 is actuated so as to place a succeeding sheet on the conveying path 3. Even during the process of transferring a printing image onto a sheet 4, the recording or imaging head 6 records the printing image for the subsequent sheet 4 on the image-transfer cylinder 5. The illustrated arrangement of the recording or imaging head 6 at the circumference of the image-transfer cylinder 5 is only by way of example because, in actual practice, the arrangement of the recording or imaging head 6 depends upon the respective technical possibilities and requirements, the disposition of the sensor 9 being adapted accordingly thereto.

Moreover, not only one printing unit, as shown in FIG. 1, but rather, a plurality of printing units disposed in tandem are generally provided. Normally the printing units operate in synchronism so that only one sensor 9 disposed ahead of the first printing unit, in the conveying direction F, suffices. However, it is also conceivable to equip each printing unit with its own sheet sensor 9.

The control device 7 may be a printing-press computer, for example, for converting the digitized printing images 8 into activating signals for the imaging or recording head 6 and for feeding/not feeding the activating signals to the imaging head 6 in accordance with or as a function of the output signal of the sensor 9.

In a case wherein the digitized printing images 8 of FIG. 1 already have a signal shape which are suitable for directly activating the recording of imaging head 6, the control device 7 may be realized, for example, as described hereinafter with additional reference to FIGS. 2 and 3.

In this embodiment of the invention, the control device 7 is a circuit disposed between a non-illustrated printing-press computer and the recording or imaging head 6, and provided for respectively disabling and enabling the data flow of the digitized printing images 8 from the printing-press computer to the recording or imaging head 6 as a function of or in accordance with the output signal of the sensor 9. In so doing, the control circuit performs the following processing steps.

Figure 2:
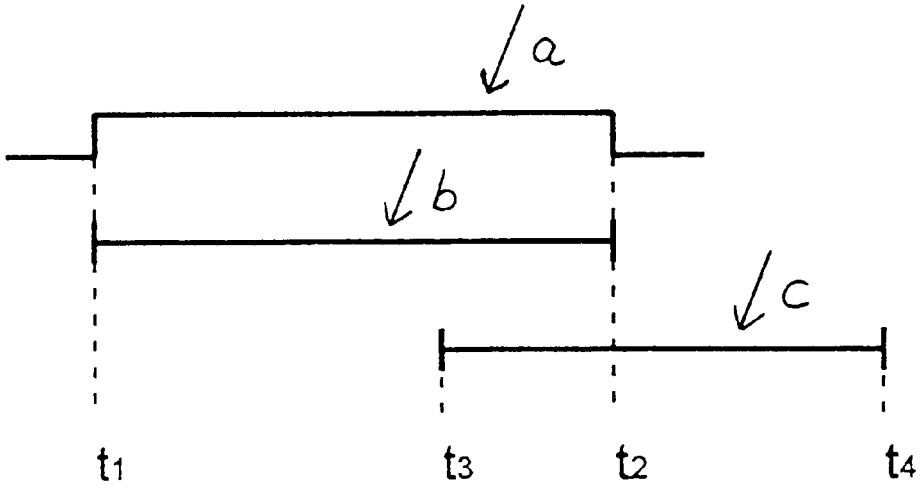
FIG. 2 is a series of timing diagrams depicting the signal processing and the periods of activation of a recording or imaging head of the printing press.

At an instant of time $t_1$, i.e. when the leading edge 4*a* of a sheet 4 passes the sensor 9, the output signal thereof changes, for example, from zero to a positive value unequal zero as shown at (a) in FIG. 2. The output signal of the sensor 9 remains at that value until, at an instant of time $t_2$, i.e. when the trailing edge 4*b* of the sheet passes the sensor 9, the value of the output signal returns to zero. Thus, each sheet 4 passing the sensor 9 supplies a signal shape of the type shown at (a) in FIG. 2 at the output of the sensor 9, the time length of which corresponds to the length of the sheet 4.

Figure 3:
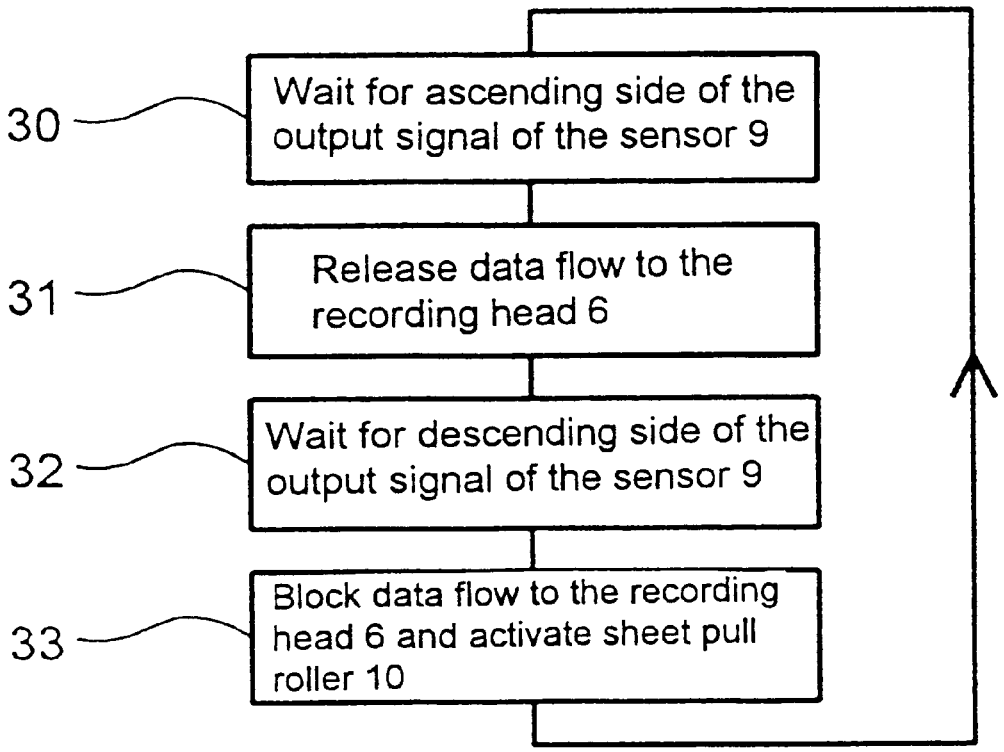
FIG. 3 is a flow chart explaining the signal processing and the activation of the recording or imaging head of the printing press.

After the printing operation has started, the control circuit 7 initially receives an output signal "zero" from the sensor 9 and waits for that output signal to change to a positive value (FIG. 3, step 30). At the instant that the control device 7 detects the upward sloping side of the output signal of the sensor 9, i.e. at the time $t_1$, the control circuit 7 enables the data flow of the digitized printing images 8 from the printing-press computer to the recording or imaging head (step 31). Thereafter, the control circuit 7 waits for the output signal of the sensor 9 to return to zero (step 32). At the instant that the control device 7 detects the downward sloping side of the output signal of the sensor 9, i.e. at the time $t_2$, the control device 7 disables the data flow of the digitized print images 8 to the recording or imaging head 6 and also actuates the sheet pull roller 10 so that the latter deposits a succeeding sheet on the conveying path 3 (step 33). Thereafter, the processing returns to step 30 and waits for the arrival of an upward sloping side of the following output signal of the sensor 9.

In this manner, the recording or imaging head 8 is active during a time interval ranging from $t_1$ to $t_2$, as shown at(b) in FIG. 2, with the recording or imaging head 6 recording or forming a printing image on the image-transfer cylinder 5.

After the image-transfer cylinder 5 has rotated through a given angle which, according to FIG. 1, is 180°, the printing image is transferred from the image-transfer cylinder 5 to the sheet 4 which, in the interim, has reached the image-transfer cylinder 5. The transfer of the printing image from the image-transfer cylinder 5 onto the sheet 4 is effected during an interval between the time $t_3$ and the time $t_4$ as shown at (c) in FIG. 2. The time interval from the time $t_3$ to the time $t_4$ and the time interval from the time $t_1$ to the time $t_2$ are equal to one another but are offset with respect to one another by a time difference $t_3-t_1$. The time difference $t_3-t_1$ corresponds to the time which the leading edge 4*a* of the sheet 4 requires in order to get from the position of the sensor 9 to the position of the image-transfer cylinder 5.

I claim:

1. A sheet conveying system in a digital printing press, comprising:

a sheet feeder conveying individual substrates to be printed to a digital printing press having a digital impression cylinder independently of a printing speed in the digital printing press and at an arbitrary spacing between successive substrates;

a sensor disposed along a conveying path between a feeder pile of said sheet feeder and a roller nip defined in the digital printing press between the digital impression cylinder and the conveying path, said sensor issuing a leading edge detection signal when a leading edge of a respective substrate is detected by said sensor and issuing a trailing edge detection signal when a trailing edge of the respective substrate is detected;

said sensor, with the leading edge detection signal, starting an imaging process whereby a printing image is imaged onto the impression cylinder at a first angular position on a periphery of the impression cylinder, and wherein the imaging process is terminated no later than when said sensor issues the trailing edge detection signal; and said sensor being disposed at a distance from the roller nip substantially equal to a developed distance from the first angular position on the periphery of the impression cylinder to the roller nip, whereby the substrates traverse a distance along the conveying path from said sensor to the roller nip during a time period which is equal to a time period required by the impression cylinder to rotate from the first angular position to the roller nip.

2. The sheet conveying system according to claim 1, wherein said sheet feeder supplies a further sheet into said conveying path immediately upon receiving the trailing edge signal from said sensor.

3. The sheet conveying system according to claim 1, wherein a sheet conveying speed along said conveying path and a printing speed are synchronized such that a spacing between successive sheets after the printing nip is substantially uniform and as small as possible.

* * * * *